United States Patent [19]

Richards

[11] Patent Number: 4,983,092

[45] Date of Patent: Jan. 8, 1991

[54] RETRACTABLE ARM/LOADER ASSEMBLY

[75] Inventor: Idwall C. Richards, Banora Point, Australia

[73] Assignee: Jayrich Engineering PTY Ltd., Chinderah, Australia

[21] Appl. No.: 398,139

[22] Filed: Aug. 24, 1989

[51] Int. Cl.[5] ..... B65F 3/14

[52] U.S. Cl. ..... 414/408; 414/420; 414/549; 414/744.5

[58] Field of Search ..... 414/403, 404, 406, 408, 414/419, 420, 421, 546, 550, 552, 553, 744.5, 549, 591

[56] References Cited

U.S. PATENT DOCUMENTS

| | | | |
|---|---|---|---|
| 3,765,554 | 10/1973 | Morrison | 414/550 X |
| 3,796,331 | 3/1974 | Dutton | 414/744.5 |
| 4,175,903 | 11/1979 | Carson | 414/408 |
| 4,342,536 | 8/1982 | Akeel et al. | 414/744.5 X |
| 4,401,407 | 8/1983 | Breckenridge . | |
| 4,435,118 | 3/1984 | Behrend et al. | 414/744.5 |
| 4,837,919 | 6/1989 | Hoppe | 414/744.5 X |

FOREIGN PATENT DOCUMENTS

| | | | |
|---|---|---|---|
| 46513 | 8/1985 | Australia . | |
| 78011 | 5/1983 | European Pat. Off. | 414/408 |
| 122493 | 8/1984 | European Pat. Off. . | |
| 3440762 | 5/1986 | Fed. Rep. of Germany | 414/744.5 |
| 655621 | 4/1979 | U.S.S.R. | 414/744.5 |
| 971732 | 11/1982 | U.S.S.R. | 414/408 |
| 1043077 | 9/1983 | U.S.S.R. | 414/408 |
| 1337321 | 9/1987 | U.S.S.R. | 414/408 |

*Primary Examiner*—Robert J. Spar
*Assistant Examiner*—Robert S. Katz
*Attorney, Agent, or Firm*—Pasquale A. Razzano

[57] ABSTRACT

A retractable arm assembly (10) suitable for use on a refuse vehicle for loading refuse comprises a first arm (11) and second arm (12) pivotally connected to each other and the vehicle so as to extend and retract substantially tranversely of the vehicle to engage a bin (56) and in a reciprocating motion empty the bin into a hopper on the vehicle. A guide in the form of a guide rail (27) located in a guideway (35), stabilizes the arm assembly (10). The arm assembly (10) is under hydraulic control and can be operated by a single operator from within the vehicle cabin.

10 Claims, 5 Drawing Sheets

RETRACTABLE ARM/LOADER ASSEMBLY

This invention relates to a retractable arm assembly for a refuse vehicle loading mechanism, in particular to a retractable arm assembly which is adapted to be interposed between the side of a refuse vehicle and a loading mechanism and controllable from the cabin of the refuse vehicle to enable the loading mechanism to engage a domestic refuse bin and deposit its contents into the refuse vehicle.

Domestic refuse collection has become a semiautomated procedure. A loading mechanism is provided at the side or rear of a refuse vehicle, the loading mechanism usually having means adapted to engage a specialised bin. In use, the operator places the bin on the loading mechanism, activates a hydraulic or electric control and the loading mechanism then deposits the contents of the bin into a hopper of the refuse vehicle. A compactor is used to compact the refuse in the hopper into a storage container on the refuse vehicle. A loading mechanism applicable to this arrangement is illustrated in European Pat. No. 122,493.

Normally, the loading mechanism performs a reciprocal motion per loading operation, i.e. it tips the bin and returns it back to a position where the worker can remove the bin from the loading mechanism.

The bin is usually a wheeled bin of square cross-section having a hinged lid. A lip extends about the top of the bin and is adapted to engage with the loading mechanism. Clamp means on the loading mechanism secure the bin in position during emptying Such a loading mechanism and bin are illustrated in the drawings accompanying this specification and are generally known in the prior art.

The prior art loading mechanisms commonly are secured to the refuse vehicle at a point adjacent a hopper and operators are required to move a bin from a roadside location and place the bin on the loading mechanism. One or more loading mechanisms may be employed. In an effort to eliminate the physical task of transporting an often heavy bin to a loading position, it was proposed to locate the loading mechanism at the end of a telescopic boom extending outwardly of the vehicle. The boom was located between the vehicle chassis and the hopper. However chassis modifications were required to support the boom and the hopper was relocated to an elevated location as a result of the interposition of the boom between the chassis and the hopper. Consequently, the loading mechanism was required to be modified in order to lift the bin to the greater height. The boom itself was heavy and cumbersome and, in addition, a heavy packer plate was usually located at the same general location on the vehicle thereby resulting in poor overall weight distribution.

In another arrangement described in Australian Patent Application No. 46,513/85 a retractable arm assembly is employed to empty a bin. This retractable arm assembly operates in a vertical plane and serves the dual function of extending outwardly from the vehicle and also performing the loading mechanism function once engaged with the bin. A problem with this arrangement is that the bin assembly and loading operations are performed in a vertical plane thus bringing into play inertial forces proportional to the total weight (including the weight of the-bin), the velocity of movement and length of the arm.

These forces present an enormous load on the truck chassis and one of the features of past arrangements of this type has been the premature failure of the truck chassis with consequential cost to the operator.

It is an object of the present invention to overcome or substantially ameliorate at least some of the abovedescribed problems of the prior art.

It is another object of the invention to provide an arm assembly for a refuse vehicle loading mechanism of relatively lightweight compact construction.

A further object of the present invention is to provide an arm assembly which may be secured to a refuse vehicle chassis without substantial modification thereof.

A still further object of the present invention is to provide an arm assembly which places the loading mechanism in a position which is visible from the cabin of the refuse vehicle to thereby allow the loading operation to be controlled from within the cabin.

In one broad form therefore, the present invention provides a retractable arm assembly for a refuse vehicle loading mechanism, said assembly comprising a first arm having one end adapted for pivotal connection to a side of said vehicle, a second arm having one end pivotally connected to the other end of said first arm and its Other end adapted for connection to said loading mechanism, said first and second arms being constrained, in use, to each move in a respective substantially horizontal plane and drive means connected to said second arm for controllably extending and retracting said other end of the second arm outwardly of said vehicle.

The first and second arms may be constrained to move in the same horizontal plane or in different horizontal planes depending on the type of pivotal connection.

Preferably the said one end of the first arm is pivotally connected to a mounting plate which bolts to the refuse vehicle chassis and when in a retracted position the first and second arms are located adjacent the chassis and the loading mechanism is located adjacent the first and second arms.

In another form of the invention there is provided a refuse vehicle including a retractable arm assembly, a loading mechanism and a guide means extending laterally of said vehicle, said retractable arm assembly comprising a first arm pivotally connected to a side of said vehicle, a second arm pivotally connected to the other end of said first arm and having its other end connected to said loading mechanism, said first and second arms being constrained, in use, to each move in a substantially horizontal plane, when the vehicle is on a horizontal surface drive means connected directly or indirectly to said second arm for controllably extending and retracting said other end of said second arm laterally of said vehicle, along said guide means.

The first and second arms are preferably connected together by a bearing assembly. Preferably bearing assemblies are also employed at the pivotal connections of the arms to the vehicle and to the loading mechanism.

The guide means can be connected directly or indirectly to the second arm. Preferably the guide means is connected to the second arm via a loading mechanism mounting plate. The guide means can include a guide rail and a guideway pivotally connected to the vehicle for limited movement of the guideway and guide rail in a vertical plane to facilitate connection of the guideway and guide rail to the refuse vehicle. The guide rail can be curved or straight. Preferably, however the guide rail is straight and restricts motion of the other end of the second arm to a straight line.

Where the guide means includes a guide rail and a guideway the mounting plate preferably includes an aperture through which the guideway and guide rail extend. The aperture is preferably sized so as to allow for the limited movement of the guideway and guide rail in the vertical plane. The guideway preferably includes rollers on which the guide rail travels. Likewise the guide rail preferably also carries rollers which travel in the guideway.

Preferably, a mounting plate is secured to the chassis of the refuse vehicle and the drive means and the pivotal connection of the said one end of the first arm are fixed to the mounting plate Thus the arm assembly can simply be bolted to the chassis. In a further preferred form the guide means also extends from the mounting plate.

In a further advantageous form the refuse vehicle includes a hopper which extends laterally of the chassis and the arm assembly mounting plate. In this embodiment the arm assembly when retracted is located beneath the hopper extension.

Advantageously the hopper is located just behind the driver's cabin forward of a rear container. A packer mechanism reciprocates in the hopper to force refuse dumped therein into the rear container. The arm assembly is mounted to the chassis just below the hopper and the loading mechanism is secured to the end of the arm assembly. The arm assembly and loading mechanism can be operated from the cabin by the driver. Typically, the driver activates the drive means to extend the arm assembly laterally to a bin. As the loading mechanism engages the bin, the bin engagement means aligns itself and engages with the lip on the bin. The driver then activates the arm assembly and loading mechanism to perform a reciprocal motion to empty the bin and return to the loading position from where the bin is disengaged.

It is advantageous to stabilise the arm assembly in its retracted position. The arm assembly preferably includes a stabilising means having a releasable look which is engaged on retraction of the arm assembly. The lock, stabilises the arm assembly against motion caused by the loading mechanism emptying a bin. Preferably, the lock is automatically released when the drive means initiates extension of the arm assembly.

It is further advantageous to abruptly stop the arm assembly on reaching its retracted position. The assembly in this form includes a stop against which the arm assembly collides when retracting causing a jolting action. The jolt assists in emptying a bin.

In a further form the refuse vehicle loading mechanism is provided with bin engagement means comprising a pivotable plate which engages a lip on the bin.

In order that the invention may be more readily understood and put into practical effect, reference will now be made to the accompanying drawings wherein.

Figure 3:
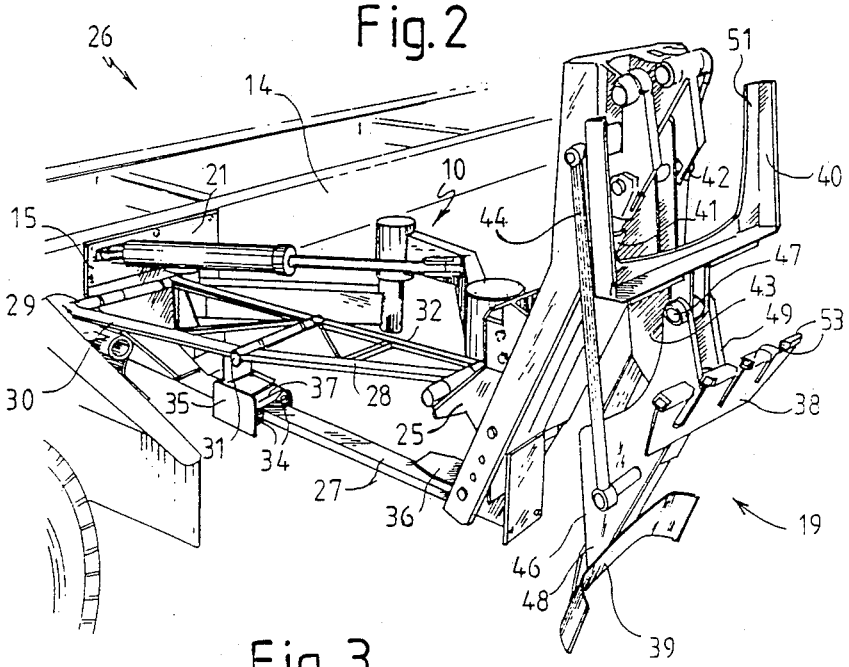

FIGS. 3(*a*), 3(*b*) and 3(*c*) illustrate a preferred guide means applicable to the invention.

Figure 4:
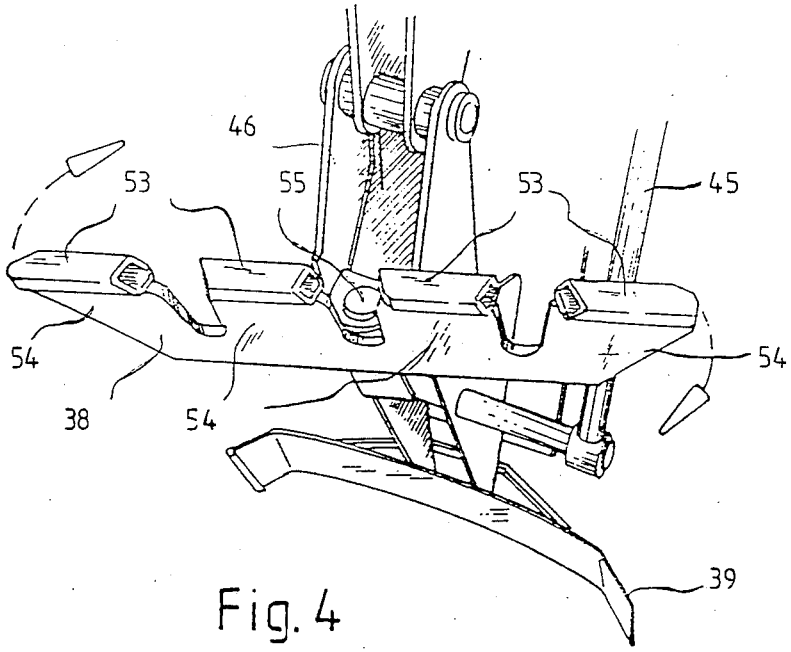
Figure 7:
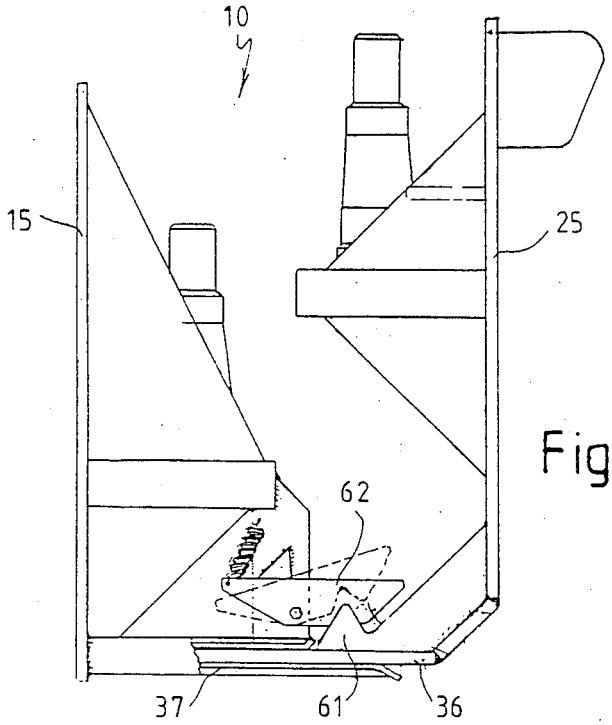
Figure 5:
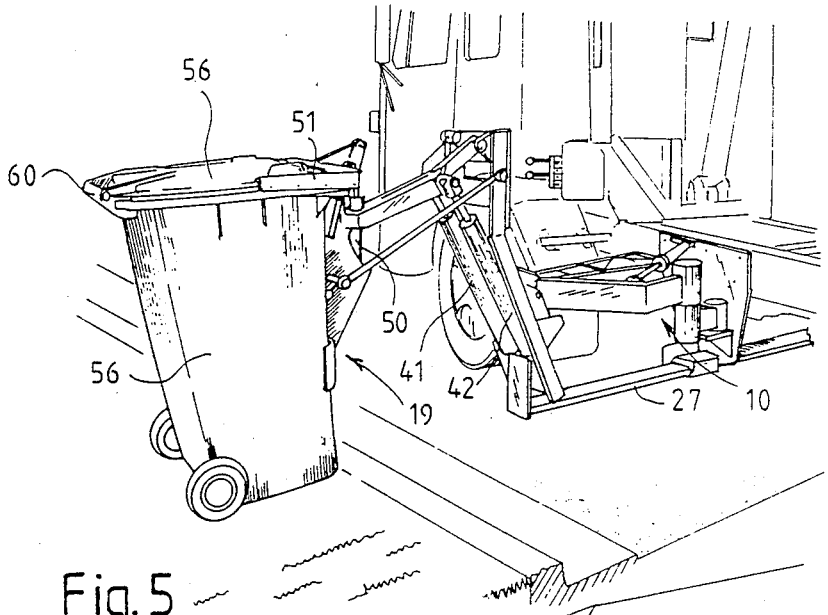
Figure 6:
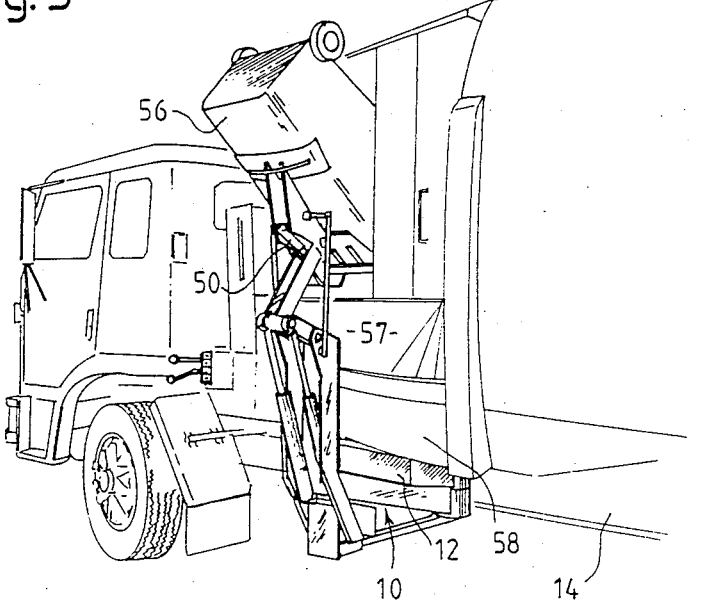

FIG. 4 is a perspective view illustrating a preferred bin engagement means for use with the present invention;

FIGS. 5 and 6 are perspective views illustrating collection of refuse using the present invention; and FIG. 7 is an elevational view illustration a preferred stabilization means for use with the present invention.

Figure 1:
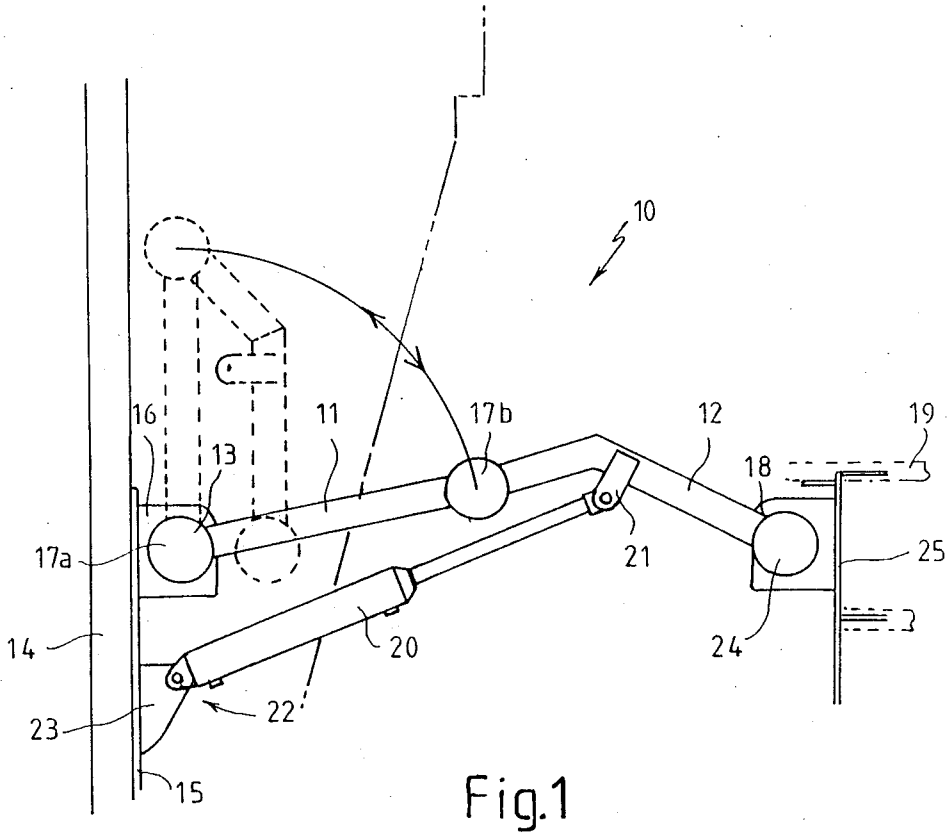
FIG. 1 is a plan view illustrating an arm assembly constructed in accordance with a preferred embodiment of the present invention.

Referring to the drawings and first to FIG. 1, there is illustrated in plan view a retractable arm assembly 10 shown fully extended, and fully retracted in broken line. The retractable arm assembly 10 comprises a first arm 11 and a second arm 12. The first arm 11 has one end 13 pivotally connected to a refuse vehicle at pivotal connection 17(*a*). Typically, the first arm is pivotally connected to a stub axle support plate 16 fixed to mounting plate !5 which is bolted to a chassis rail 14. The second arm 12 has one end pivotally connected to the other end of the first arm 11 at pivotal connection 17.

The second arm 12 is adapted at its other end 18 to be connected to a loading mechanism 19 shown in broken outline.

The pivotal connections 17(*a*), 17(*b*) include vertical hub and vertical stub axles which constrain the arms 11 and 12 to move in substantially horizontal planes.

The second arm 12 is connected to a drive means in the form of a hydraulic cylinder assembly 20 for controllably extending and retracting the end 18 of the second arm 12 laterally of the refuse vehicle 14 to move the arms between the fully extended and fully retracted position. The connection to the hydraulic cylinder assembly 20 is through a lug 21 extending from the second arm 12. The hydraulic cylinder assembly 20 is connected at its other end 22 to a plate 23 extending from mounting plate 15.

In the illustrated embodiment, the end 18 of the second arm 12 includes a pivotal connection 24 so that the loading mechanism 19 can pivot relative to the second arm 12. The loading mechanism 19 is preferably secured to the end 18 via mounting plate 25.

In operation the arm assembly 10 is driven between retracted and extended positions by the application of pressurised hydraulic fluid to hydraulic cylinder assembly 20.

In the retracted position the first and second arms 11 and 12 are located adjacent the refuse vehicle chassis 14 and the loading mechanism 19 is located adjacent the arms 11 and 12.

Figure 2:
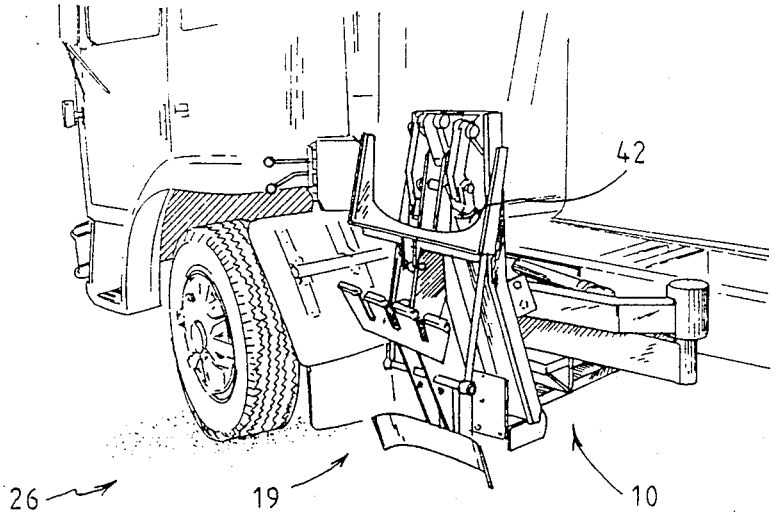
FIGS. 2 and 3 are perspective views illustrating the arm assembly of FIG. 1 operatively connected to a refuse vehicle and a loading mechanism.

Referring to FIGS. 2 and 3 there is illustrated a refuse vehicle 26 having an arm assembly 10 as described with reference to FIG. 1 and like numerals have been used to illustrate like features. For clarity, the hopper is not shown in FIGS. 2 and 3. The arm assembly 10 is illustrated in its retracted position in FIG. 2 and in its extended position in FIG. 3.

A loading mechanism 19 is operatively secured to mounting plate 25. The mounting plate 25 is connected to dual guide means in the form of a metal rail 27 and a folding guide 28. The rail 27 and folding guide 28 restrict extension and retraction of the end 18 of the second arm 12 along a defined path transverse to the refuse vehicle 25. The folding guide 28 includes two members 30, 32 pivotally connected along a longitudinal pivot axis 31. The members 30 and 32 are also pivotally connected to mounting plates 15 and 25 respectively so that they fold together when the arm assembly is retracted. The rail 27 on the other hand is constrained to run between rollers 34 in a guideway 35 secured to mounting plate 15.

Rail 27 and folding guide 28 can be employed together as in FIG. 3 or individually. Preferably rail 27 is used alone.

In this regard reference is made to FIGS. 3(*a*), (*b*) and (*c*) which illustrates one particular preferred guide rail 27 and guideway 35 and their connection to the vehicle via mounting plate 15 and indirectly to the second arm 12 via mounting plate 25.

In FIG. 3(*a*) the guide rail 27 and mounting plate 25 are illustrated in exploded perspective view and as can be seen the guide rail includes a tube 100 welded to the end of the guide rail, a pivot pin 101 shown in cutaway can be inserted through the tube to pivotably connect the guide rail 27 to the mounting plate 25.

The guideway 35 is illustrated in FIGS. 3(*b*) and 3(*c*). The guideway 35 in this embodiment is a hollow tube of rectangular transverse cross-section. The guideway 35 is pivotally connected to a vehicle chassis rail 102 via a bracket 103 and includes two stubs 104 which permit pivotal movement of the guideway 35.

Figures 3A, 3B, 3C:
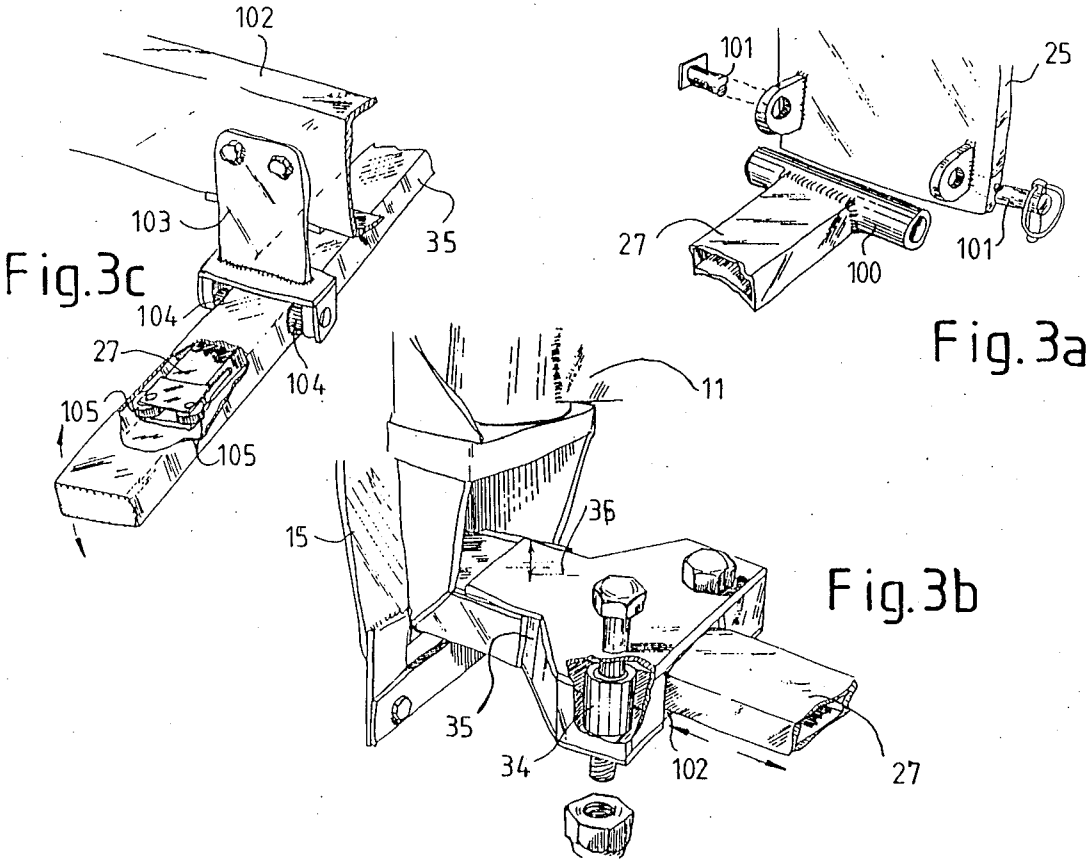

Seen more clearly in FIG. 3(*b*) the guide rail 35 passes through the mounting plate 15 and depending on the relative position of stub 104 (FIG. 3*c*) and pin 101 (FIG. 3*a*) the guide rail 27 and guideway 35 can be positioned to operate horizontally or at an angle to the horizontal. This arrangement assists in fitting the guideway and guide rail to various different vehicle chassis and enables the guide rail 27 and guideway 35 to be positioned to provide clearance from obstructions which may be mounted on the vehicle beneath the chassis.

To facilitate movement of the guide rail 27 along the guideway 35 the guide rail is fitted with rollers 105 at its other end (illustrated in cuttaway view in FIG. 3*c*) and the guideway 35 is fitted with roller 34 as mentioned earlier.

Turning back to FIGS. 2 and 3 it will be seen that the plate 25 includes a tongue or flange 36 which engages with a slot 37 upon retraction of arm assembly 10. Preferably a releasable look holds the tongue 36 in slot 37 while a bin is being emptied (seen more clearly in FIG. 7).

The loading mechanism 19 includes bin engagement means in the form of a pivotable fingered plate 38, a bracket 39 and a clamp 40. Two main rams 41 and 42 act on a central arm 43 in order to elevate finger plate 39 through an arc defined by connecting rods 44 and 45.

The bracket 39 and finger plate 38 and connecting rods 44 and 45 are attached to an auxiliary arm 46. A pivot 47 connects the central arm 43 to the auxiliary arm 46.

The clamp 40 is driven about pivot 47 by a ram located between the plates 48 and 49 of the auxiliary arm 46. This ram is shown in FIGS. 5 and 6 by numeral 50. The clamp 40 is driven from the vertical position illustrated in FIGS. 2 and 3 to a horizontal position shown in FIG. 5 and a flange 51 is adapted to seat on a lip extending about the periphery of a bin. The flange 51 when horizontal will seat on an upper side of the lip thereby clamping the lip against upper surfaces 53 of the finger plate 38.

The operation of the finger plate is illustrated in FIG. 4. Like numerals have been used to illustrate like features.

The finger plate 38 has four spaced fingers 54 and is secured to the auxiliary arm 46 at a pivot 55. The finger plate 38 can be pivoted as indicated by the arrows through an arc subtending an angle of approximately 30 degrees.

In operation the finger plate will pivot about pivot 55 in order to align with a bin. In addition the bracket 39 can be used to contribute to the aligning of a bin.

If there is substantial misalignment between the finger plate 38 and bin, the bin can be aligned using the combined effect of the arm assembly, the pivoting finger plate 38 and the alignment bracket 39 to physically push a bin into sufficient alignment so that the finger plate 38 can be engaged.

Once a bin has been engaged (as illustrated in FIG. 5) the contents of the bin may be emptied into the refuse vehicle. When emptying the bin, as shown in FIG. 6, the arm assembly 10 is fully retracted and bin 56 is inverted over a hopper 57. The hopper 57 extends outwardly of the chassis rail 12 and the first and second arms 11 and 12 are located beneath the outward extension 58. (The hopper is not shown in FIG. 5)

In operation the arm assembly and loading mechanism can be activated by a single control to move from the extended position of FIG. 5 after engaging the bin 56 to the emptying position and back to the extended position for disengaging the bin. The motion can be described as reciprocal.

When the arm assembly is retracted during the emptying procedure it is abruptly stopped to jolt to the loading mechanism. Preferably a stop is provided in association with the guideway 35 and a stabilization means (described below).

In one form of stop the guideway 35 can be arranged to be slightly outward of the maximum retraction of the hydraulic cylinder assembly 20. The consequence of this arrangement is that as the arm assembly is retracted it is abruptly stopped and a jolt is imparted to the loading mechanism. At this stage the bin in inverted and the jolt generated by the abrupt stop assists in dislodging compacted refuse from the bin.

FIG. 7 illustrates one preferred form of stop which includes a stabilization means for use with the arm assembly of FIG. 1. The arm assembly 10 has been illustrated with the first and second arms omitted for clarity. The arm assembly is illustrated in its retracted position. Like numerals illustrate like features.

At the base of chassis mounting plate 15 is welded a guideway 37 which receives a tongue 36. The tongue 36 has stabilization means in the form of a catch 61 which engages a releasable look in the form of a pivoting latch 62. The arrangement of FIG. 7 provides both a stop and also a stabilization of the assembly during emptying of a bin. The latch 62 also serves as a positive lock to enhance the overall safety of the arm assembly.

The foregoing describes only one embodiment of the invention and further modifications and variations may be made by persons skilled in the art without departing from the broad scope and ambit of the invention as defined in the appended claims. For example, the arm assembly of the present invention may be used with different loading mechanisms.

What I claim is:

1. A refuse vehicle including a retractable arm assembly comprising first and second arms having respective ends pivotally coupled together a loading mechanism coupled to the other end of the second arm and a guide means which, in use, extends outwardly of said vehicle, said first arm being pivotally coupled to a side of said vehicle whereby said first and second arms are each constrained to move in substantially horizontally planes when the vehicle is on a horizontal surface, drive means being coupled to said second arm or to the loading mechanism for controllably extending and retracting said other end of said second arm outwardly of said vehicle with and in the direction of travel of said guide means.

2. A refuse vehicle as defined in claim 1 including a vehicle chassis, a hopper located above the vehicle chassis and extending outwardly of the chassis, said arm assembly when retracted being located beneath said hopper.

3. A refuse vehicle according to claim 2 wherein said guide means comprises a guide rail fixed directly or indirectly to the said other end of said second arm and a guideway fixed directly or indirectly to the refuse vehicle, said guide rail co-operating with said guideway to restrict motion of the said other end of said second arm along a straight line.

4. A refuse vehicle according to claim 2 wherein the loading mechanism includes a bin engagement member, said bin engagement member being pivotable about an axis located transverse to the direction of motion of said other end of said guide rail co-operating with said guideway to restrict motion of the said other end of said second arm along a straight line.

5. A refuse vehicle according to claim 1 wherein said guide means comprises a guide rail fixed directly or indirectly to the said other end of said second arm and a guideway fixed directly or indirectly to the refuse vehicle, said second arm to facilitate alignment of the bin engagement member with a bin.

6. A refuse vehicle according to claim 5 wherein pivotal connections connect the guide rail and said guideway directly or indirectly to the second arm and the vehicle respectively for limited movement of the guide rail and the guideway in a vertical plane.

7. A refuse vehicle according to claim 6 wherein the loading mechanism includes a bin engagement member, said bin engagement member being pivotable about an axis located transverse to the direction of motion of said other end of said second arm to facilitate alignment of the bin engagement member with a bin.

8. A refuse vehicle according to claim 5 wherein the loading mechanism includes a bin engagement member, said bin engagement member being pivotable about an axis located transverse to the direction of motion of said other end of said second arm to facilitate alignment of the bin engagement member with a bin.

9. A refuse vehicle according to claim 1 wherein the loading mechanism includes a bin engagement member, said bin engagement member being pivotable about an axis located transverse to the direction of motion of said other end of said second arm to facilitate alignment of the bin engagement member with a bin.

10. A refuse vehicle including a retractable arm assembly comprising first and second arms having respective ends pivotally coupled together, a loading mechanism coupled to the other end of the second arm and a guide means which, in use, extends outwardly of said vehicle, vehicle mounting means by which the other end of said first arm is pivotally coupled to a side of said vehicle whereby said first and second arms are each constrained to move in substantially horizontal planes when the vehicle is on a horizontal surface, said drive means being coupled to said second arm or to the loading mechanism for controllably extending and retracting said other end of said second arm outwardly of said vehicle with and in the direction of travel of said guide means, the first and second arms when retracted being located adjacent the vehicle mounting means and the locating mechanism being located adjacent the first and second arms.

* * * * *